US007390168B2

(12) United States Patent
Liang

(10) Patent No.: US 7,390,168 B2
(45) Date of Patent: Jun. 24, 2008

(54) VORTEX COOLING FOR TURBINE BLADES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 218 days.

(21) Appl. No.: 11/325,216

(22) Filed: Jan. 3, 2006

(65) Prior Publication Data

US 2006/0275119 A1 Dec. 7, 2006

Related U.S. Application Data

(63) Continuation of application No. 10/791,575, filed on Mar. 2, 2004, now Pat. No. 6,981,846.

(60) Provisional application No. 60/454,120, filed on Mar. 12, 2003.

(51) Int. Cl.
*F01D 5/18* (2006.01)

(52) U.S. Cl. ..... 416/97 R

(58) Field of Classification Search ..... 416/90 R, 416/97 R; 415/115

See application file for complete search history.

(56) References Cited

U.S. PATENT DOCUMENTS 4,407,632 A 10/1983 Liang
4,505,639 A 3/1985 Groess et al.
4,669,957 A * 6/1987 Phillips et al. ..... 416/97 R
4,752,186 A 6/1988 Liang
5,263,820 A 11/1993 Tubbs
5,486,093 A 1/1996 Auxier et al.
5,690,472 A 11/1997 Lee
5,720,431 A 2/1998 Sellers et al.
5,993,156 A 11/1999 Bailly et al.
6,129,515 A 10/2000 Soechting et al.
6,247,896 B1 6/2001 Auxier et al.
6,254,334 B1 7/2001 LaFleur
6,280,140 B1 8/2001 Soechting et al.
6,932,573 B2 8/2005 Liang

* cited by examiner

*Primary Examiner*—Richard Edgar
(74) *Attorney, Agent, or Firm*—John Ryznic

(57) ABSTRACT

A near wall cooling technique for cooling the pressure and suction sides of a turbine airfoil that includes a matrix of cells oriented chord-wise and extending longitudinally having vortex chambers with vortex creating passages feeding coolant from interior of the blade to each of the cells, interconnecting passageways interconnecting each of the vortex chambers and discharge film cooling passageway discharging coolant adjacent the outer surface of the pressure and suction sides. The alternate passageways are staggered and each are tangentially oriented to introduce a swirling motion in the coolant as it enters each of the vortex chambers. The cells may be oriented to be in a staggered or in an in-line array and the number of cells, the number of vortex chambers and the dimension of the cells, vortex chambers and passageways are selected to match the heat load and the temperature requirements of the material of the blade. The direction of flow within each cell is selected by the designer. The aft portion may be internally cooled before discharging the coolant as a film upstream of the gage point to avoid aerodynamic losses associated with film mixing.

14 Claims, 3 Drawing Sheets

VORTEX COOLING FOR TURBINE BLADES

CROSS-REFERENCE TO RELATED APPLICATIONS

This application is a continuation of previously filed U.S. Regular application Ser. No. 10/791,575 filed on Mar. 2, 2004 entitled VORTEX COOLING OF TURBINE BLADES, no U.S. Pat. No. 6,981,846 issued on Jan. 3, 2006, which related to a Provisional Application 60/454,120 filed on Mar. 12, 2003 entitled NEAR WALL MULTI-VORTEX COOLING CONCEPT.

STATEMENT REGARDING FEDERALLY SPONSORED RESEARCH OR DEVELOPMENT

None.

BACKGROUND OF THE INVENTION

1. Field of the Invention.

This invention relates to air cooled turbines for gas turbine engines and particularly to cooling of the pressure and suction surfaces of the turbine blade with coolant air that has imparted thereto vortices.

2. Description of the Related Art including information disclosed under 37 CFR 1.97 and 1.98.

As is well known in the gas turbine engine technology, the efficiency of the engine is greatly enhanced by increasing the temperature of the turbine and/or reducing the amount of air that is required to maintain the turbine components within their tolerance limits. In other words, the material used for the turbine blades must be able to withstand the temperature and hostile environment that is seen in the turbine section. Engineers and scientists have been working for many years at improvements to provide materials capable of withstanding higher temperatures and to reduce the amount of coolant for achieving satisfactory cooling of the turbine components and particularly the turbine blade.

An example of cooled turbine blades is exemplified in U.S. Pat. No. 5,720,431 granted to Sellers, et al on Feb. 24, 1998 entitled COOLED BLADES FOR A GAS TURBINE ENGINE which teaches the use of feed chambers and feed channels where the feed channels extend from the root of the blade to the tip and include a discharge opening at the tip, the feed chamber connects to the source of coolant and through radial spaced impingement cooling holes replenishes the air in the feed channels. This teaching relates to the leading edge, trailing edge and the mid chord section. It is noted that this invention is principally concerned with the suction surface and the pressure surface in the mid chord section. This reference is incorporated herein by reference and should be referred to for a detailed description of air cooled turbine blades utilized in gas turbine engines.

U.S. Pat. No. 6,129,515 granted to Soechting, et al on Oct. 10, 2000 entitled TURBINE AIRFOIL SUCTION AIDED FILM COOLING MEANS is also included herein because not only does it describe cooled turbine blades, but it is particularly directed to teachings that is directed to means for slowing the velocity of the discharge air from the air film cooling holes so as to better disperse the air as it leaves the discharge ports and hence, tend to more effectively provide a film of cooling air adjacent to the outer surface at the pressure surface of the blade. It will be noted, for example, that the teaching includes step diffuser to attain a wider diffusion angle of the discharging film. This patent is also incorporated herein by reference.

U.S. Pat. No. 5,486,093 granted to Auxier et al on Jan. 23, 1996 entitled LEADING EDGE COOLING OF TURBINE AIRFOILS is included herein because it teaches the use of helix shaped cooling passages to enhance convective efficiency of the cooling air and to improve discharge of the film cooling air by orienting the discharge angle so that the discharging air is delivered more closely to the pressure and suction surfaces. The helix holes place the coolant closer to the outer surface of the blade to more effectively reduce the average conductive length of the passage so as to improve the convective efficiency. Also higher heat transfer coefficients are produced on the outer diameter of the helix holes improving the capacity of the heat sink. This patent is likewise incorporated herein by reference.

As one skilled in this art will appreciate the heretofore design of cooled turbine blades typically utilize radial flow channels plus re-supply holes in conjunction with film discharge cooling holes as is exemplified in U.S. Pat. No. 5,720,431, supra. While this patent discloses a near wall cooling technique, this cooling construction approach has its downside because the hot gas temperature and pressure variation of the engine's working medium makes the control of the radial and chord-wise cooling flow difficult to achieve. A single pass radial channel flow as taught by the Sellers (U.S. Pat. No. 5,720,431) patent, supra, is not the ideal method of utilizing cooling air and as a consequence, this method results in a low convective cooling effectiveness.

The present invention obviates the problem noted in the above paragraph. The design philosophy of this invention as compared to the teachings noted above and the results obtained by the utilization of this invention as a cooling technique for turbine blades will enhance the cooling effectiveness and hence, will improve the efficiency of the engines. Essentially, this invention relates to cooling the surfaces of the pressure side and suction side of the airfoil and provides a matrix of square or rectangular shaped cells (although other shapes could also be employed), each of which have discrete cooling passage(s) formed in the wall of the airfoil adjacent to the pressure surface and to the suction surface of the blade resulting in a near wall cooling technique of the turbine airfoil. This matrix can be made to span the longitudinal and chord-wise directions to encompass the entire pressure and suction surfaces or to a lesser portion depending on the heat load of a particular engine application. These cells not only can be arranged in an online array along the airfoil main body, the cells can also be a staggered array along the airfoil main body.

In addition, this invention contemplates the use of means for generating vortices in each of the passages to enhance heat transfer and the conductive characteristics of the cooling system. The multi-vortex cell of this invention serves to generate a high coolant flow turbulence level and, hence, yields a very high internal convection cooling effectiveness in comparison to the single pass construction described in the Sellers (U.S. Pat. No. 5,720,431) patent, supra.

In accordance with this invention, the designer can design each individual cell based on airfoil gas side pressure distribution in both the chord wise and radial directions. Additionally each cell can be designed to accommodate the local external heat load on the airfoil so as to achieve a desired local metal temperature.

The discharge angle of the discharge passage of the vortex cooling passage is oriented to provide a film cooling hole where the discharge angle will enhance the film cooling effectiveness of the coolant. As will be appreciated by those familiar with this technology, film cooling on the suction side downstream of the gage point, i.e., the point where the two adjacent blades define the throat of the passage between blades, adversely affects the aerodynamics of film mixing and hence is a deficit in performance. This then becomes a trade-off in design to either obtain the benefits of film cooling in deference to these aerodynamic losses. To avoid the aerodynamic loses in heretofore known cooling schemes, in accordance with this invention cooling suction the suction side of the blade downstream of the gage point is provided by the airfoil internal multi-pass serpentine passage. This invention has the advantage over these schemes and hence is a significant improvement because the aft portion of the suction side wall of the airfoil can be internally cooled with the multi-vortex cell of this invention before discharging the coolant through the film discharge holes as a film upstream of the gage point in contrast to being discharged downstream of the gage point and thus, avoiding the aerodynamic losses associated with film mixing.

BRIEF SUMMARY OF THE INVENTION

An object of this invention is to provide for the turbine of a gas turbine engine improved means for cooling the pressure and suction surfaces of the airfoil.

A feature of this invention is to provide for the airfoil, a matrix consisting of a plurality of cells spanning the radial and chord-wise expanse of the airfoil and each cell includes a plurality of cylindrically shaped spaced channels formed in the wall of the turbine airfoil adjacent to the exterior thereof and being discretely interconnected by a coolant through a passage that is disposed tangentially thereto so as to impart a vortex within the channel.

Another feature of this invention is to provide a plurality of channels near the pressure and suction surfaces of a turbine airfoil wherein each of said channels extend radially and are spaced chord-wise and each channel is fluidly connected to the adjacent by a passage which passage for alternate connections is radially spaced therefrom and the coolant is received from a mid-chord passage and discharged from the film cooling slot. The flow from channel to channel may be in the direction of the tip to the root of the blade or vice versa.

Another feature of this invention is to provide a matrix of cells on the suction side of the airfoil such that a plurality of radially extending spaced channels formed in the wall of the turbine downstream of the gage point and where each channel includes vertically flowing coolant and are fluidly connected to each other for cooling the suction side wall and discharging the coolant into a film cooling slot upstream of the gage point.

The forgoing and other features of the present invention will become more apparent from the following description and accompanying drawings.

DETAILED DESCRIPTION OF THE INVENTION

Figure 1:
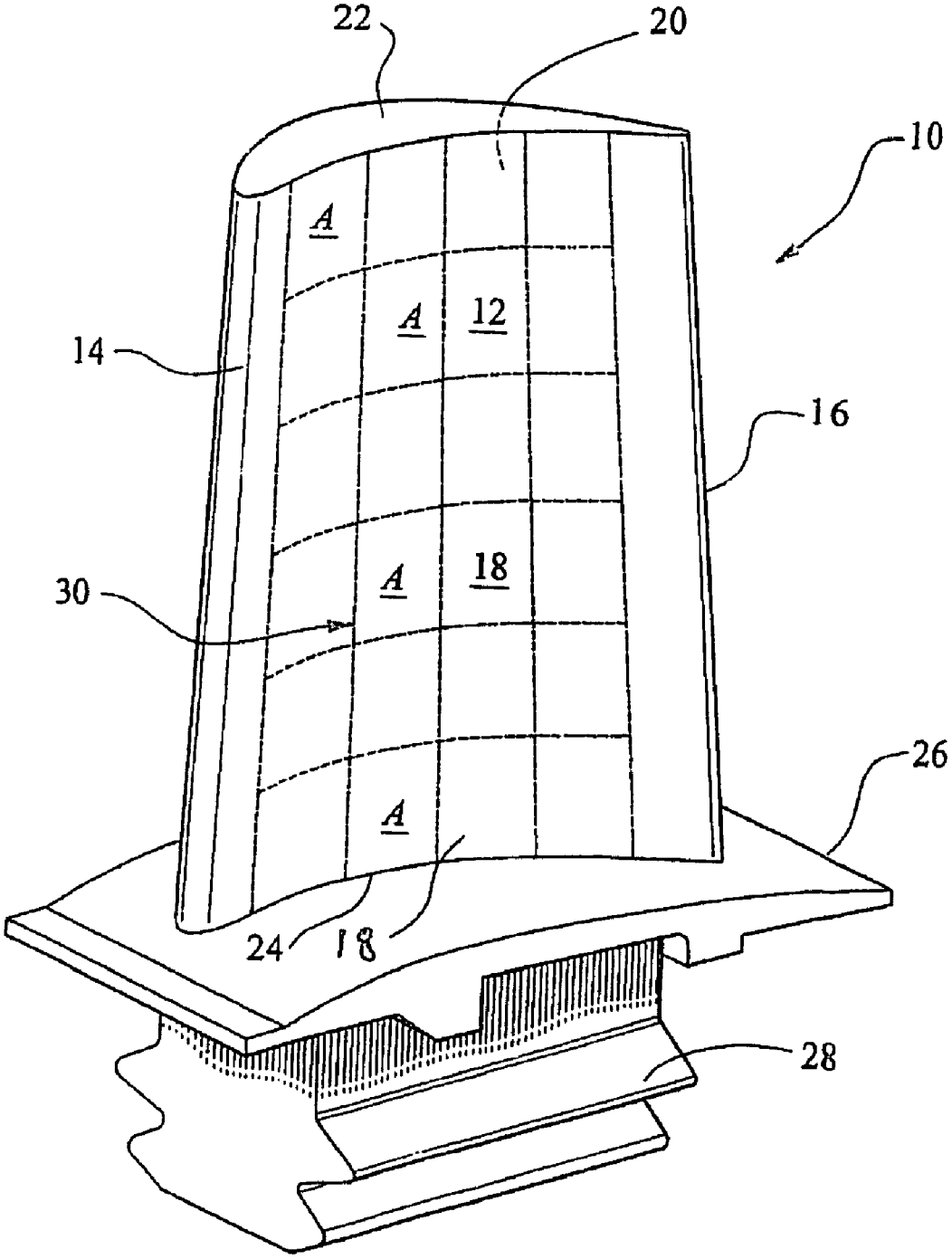
FIG. 1 is a perspective view illustrating a turbine blade for a gas turbine engine having superimposed thereon a matrix designating each of the cells of this invention.
Figure 2:
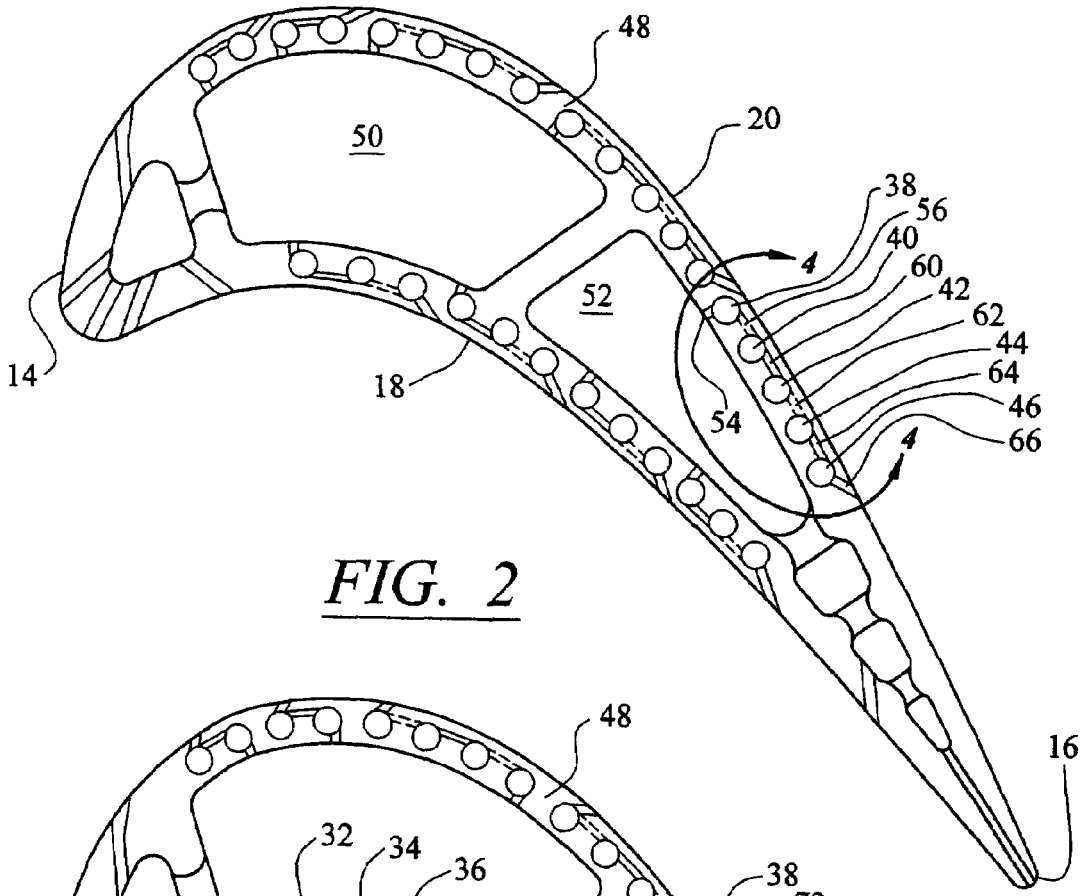
FIG. 2 is a view of a station taken along the chord-wise direction illustrating the details of the cells of this invention.

While this invention is being described showing a particular configured turbine blade as being the preferred embodiment, as one skilled in this art will appreciate, the principals of this invention can be applied to any other turbine blade that requires internal cooling and could be applied to vanes as well. Moreover, the number of cells and their particular shape and location can be varied depending on the particular specification of the turbine operating conditions. The leading edge and trailing edge cooling configuration and not a part of this invention and any well known techniques could also be utilized and as mentioned earlier the technique described in U.S. patent application Ser. No. 10/791,581 could equally be utilized.

A better understanding of this invention can be had by referring to FIGS. 1 through 5 which illustrate a turbine blade generally indicated by reference numeral 10 (FIG. 1) comprising the airfoil 12 having a leading edge 14, a trailing edge 16, a pressure side 18, a suction side 20, a tip 22 and a root 24 and the airfoil 12 extends from the platform 26 and the attachment 28, which in this illustration is a typical fir-tree attachment. The blade 10 is mounted on a turbine disc (not shown) which is attached to the main engine shaft (not shown) for rotary motion. As is typical in gas turbine engines, air introduced to the engine through the inlet of the engine is first pressurized by a compressor (a fan may be utilized ahead of the compressor) and the pressurized air is diffused and delivered to a combustor where fuel is added to generate high pressure hot temperature gases which is the engine working medium. The engine working medium is delivered to the turbine section where energy is extracted to power the compressor and the remaining energy is utilized for developing thrust or horsepower, depending on the type of engine.

Figure 3:
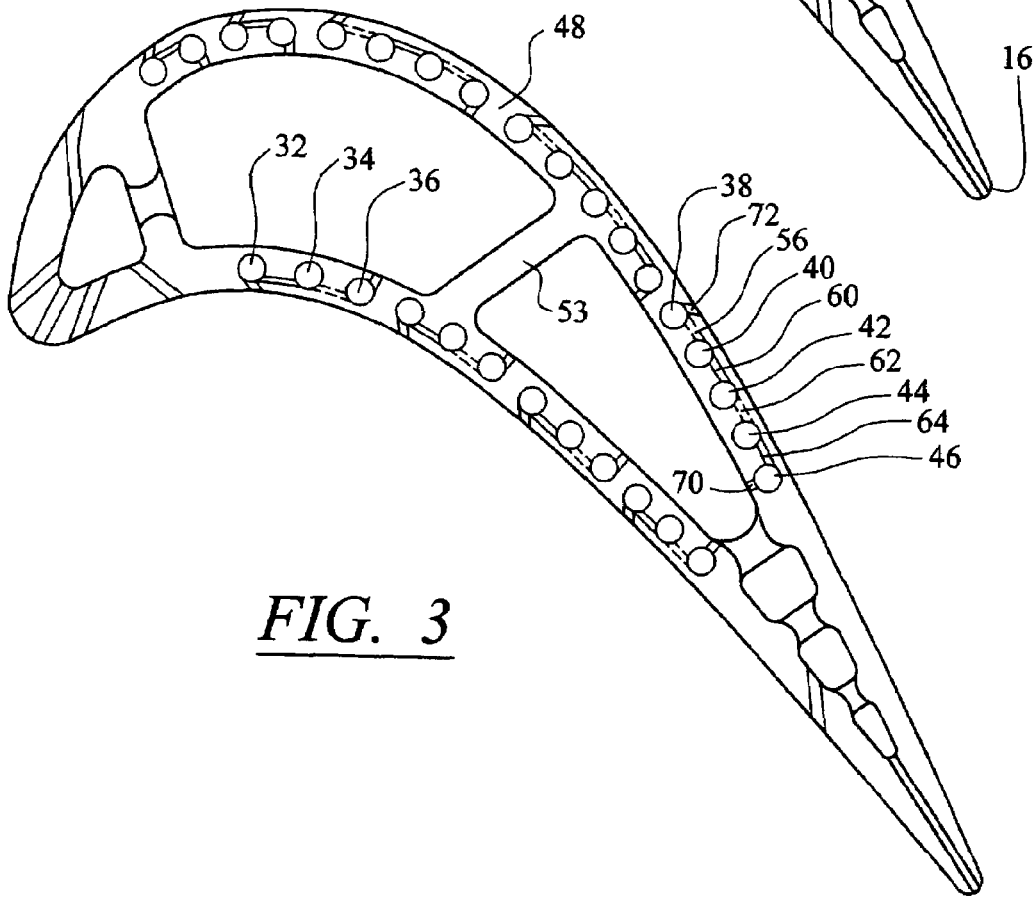
FIG. 3 is a view of the same station of the blade depicted in FIG. 2 where the direction of flow through each cell is reversed.

Since gas turbine engines are well known, details thereof are omitted here-from for the sake of convenience and simplicity. However, it is noted that adjacent blades 10 define the space where the engine working medium flows and the dimension of the radial stations of this space varies such that at some station the area is the smallest and defines a throat which is the gage point. Superimposed on the pressure side 18 is a matrix generally indicated by reference numeral 30 is a plurality of rectangular shaped cells (A) indicated by the dashed lines that span the radial and chord-wise direction of the blade 10. The size and space of each cell can vary depending on the particular application and even in this description, it will be noted that the cells on the suction side of the blade are dimensioned differently from the cells on the pressure side of the blades and differ from each other. As will be described in more detail herein below, for example, the cells on the pressure side includes three (3) cylindrical chambers 32, 34, and 36 and there are two (2) chambers in some cells on the suction side and five (5) chambers in others. (FIGS. 2 and 3) for the sake of convenience and simplicity, a single cell will be described with the understanding that the principal of this invention applies to all of the cells unless indicated otherwise. It should be pointed out here that the only difference between the structure disclosed in FIG. 2 and the structure disclosed in FIG. 3 is the direction of coolant flow in the cells and this will be more fully explained in the paragraph that follows herein below.

Figure 4A:
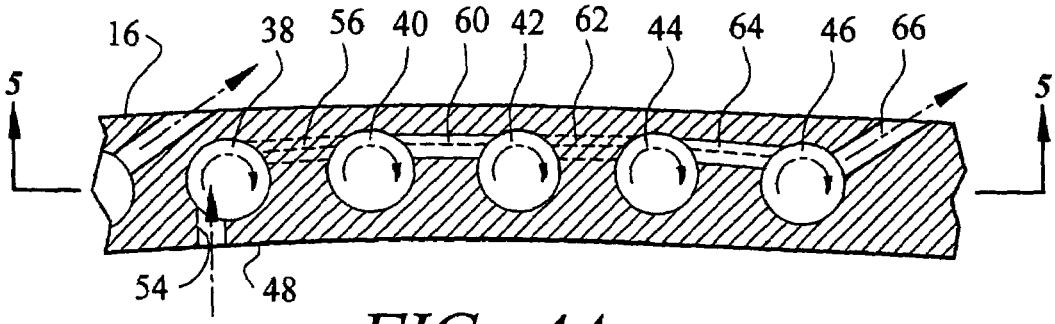
FIG. 4A is a close-up view taken around a cell shown by section 4-4 of FIG. 2.
Figure 5:
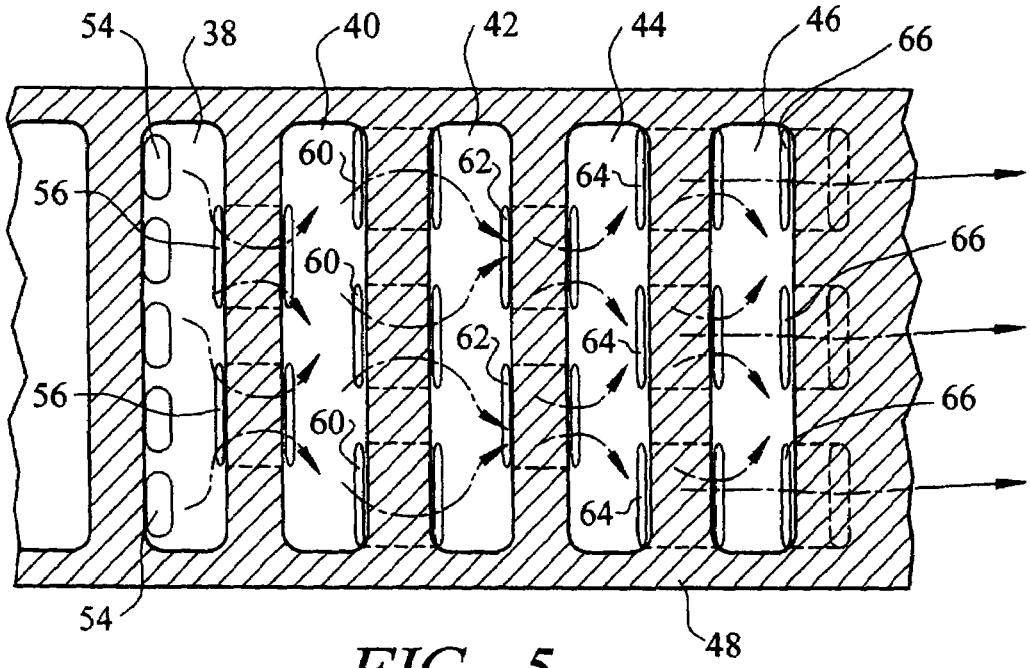
FIG. 5 is a sectional view taken along lines 5-5 of FIG. 4A illustrating the flow pattern within a cell.

Reference will be made to FIG. 4A and FIG. 5 for a detailed description of one of the cells (A). As noted, cell (A) includes five (5) cylindrical chambers 38, 40, 42, 44 and 46 formed in the wall 48 and extend in the direction of the leading edge 14 toward the trailing edge 16 and are adjacent to the exterior surface of the suction side. In this embodiment, the wall 48 is configured to define the airfoil and is sufficiently thick to accommodate the chambers of each of the cells (A) and thus allows the location of these chambers to be close to the exterior surface of the airfoil and to the engine working medium, so as to achieve near wall cooling. In this blade, the wall 48 defines a pair of mid-span coolant supply passages 50 and 52 separated by the spar 53, extending radially from the root 24 and the tip 22 that receive a coolant in a well-known manner from the bottom of the attachment 28. Typically, this coolant is air bled from the compressor (not shown). Flow of the coolant from passages 52 flows into the first chamber 38 through the plurality of radially spaced slots 54 formed in wall 48 which slots are oriented tangentially with respect to the cylindrical chamber 38. The purpose of the particular location and orientation of each of the slots 54 is to impart a vortex motion to the flow being introduced into chamber 40, then chamber 42, then chamber 44, then lastly into chamber 46 through the span-wise passages 56, 60, 62 and 64, respectively. The flow from this cell (A) in then discharged through film cooling slots 66 to form a film of cooling air adjacent the outer surface of the wall 48 on the suction side 20 via the film cooling slots 66. The series arrangement of the vortex cooling chambers (38,40,42,44,46) in the present invention provides more effective near wall convection cooling of the airfoil than would the single vortex film cooling chamber disclosed in the prior art Phillips et al U.S. Pat. No. 4,669,957. The Phillips patent discloses a plurality of individual vortex chambers arranged along the airfoil wall in which each is supplied with a cooling flow and in which each vortex chamber discharges the flow out through a distinct and separate film cooling hole. The present invention is a series of vortex chambers that provide convective near wall cooling. The Phillips invention provides film cooling. In the embodiment of the Present invention in FIG. 4A, a series of five vortex chambers are connected in series. In the Phillips invention, five vortex chambers would require a cooling air flow amount of 5W (W1+W2+W3+W4+W5) with a flow of W for each of the five vortex chambers. In the present invention of FIG. 4A, a total cooling air flow of 5W is used to pass through all five of the vortex chambers because they are connected in series. Thus, the cooling flow in the present invention is 5 times that of the Phillips invention and therefore produces a much higher cooling per area and therefore a much better convection cooling capability. As is apparent from this FIG. 4A, each of the passages 56, 60, 62 and 64 are offset from each other in the radial direction and are tangentially disposed relative to the cooperating cylindrical chamber to maximize the creation of the vortex in each of the chambers and hence, maximize the cooling effectiveness of this technique. It will also be noted that the angle of slots 66 with respect to the outer surface of wall 48 is selected to maximize the film cooling effect of the coolant being discharged from the blade 10.

Figure 4B:
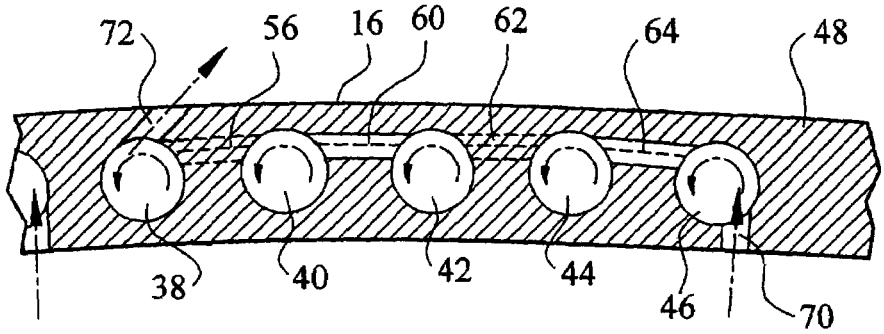
FIG. 4B is a view identical to the view depicted in FIG. 4A modified to illustrate the flow pattern when the flow is reversed with a cell.

FIG. 4B illustrates the flow pattern is reversed from the pattern disclosed in connection with the cell depicted in FIG. 4A where the flow of the coolant in a cell is directed from a direction of the trailing edge toward the leading edge. (Like reference numerals depict like parts in all Figs.). As noted in this instance, the coolant is admitted into chamber 46 via the slots 70 and ultimately discharged from the blade through film cooling slots 72 and the near wall cooling technique is identical to that described in connection with the configuration depicted in FIG. 4A.

As mentioned in the above paragraphs, in addition to the other mentioned benefits, this invention provides a significant improvement for the airfoil suction side wall cooling because it allows the design to internally cool the aft portion of the suction side wall of the airfoil before dumping the coolant from the blade through the film cooling slots upstream of the gage point. This concept serves to provide effective convective cooling while avoiding aerodynamic losses associated with film mixing at the junction point where the air discharges from the blade and mixes with the engine fluid working medium. This concept affords the designer to utilize the vortex cells in a single, double or multiple series of vortex formation depending on the airfoil heat load and metal temperature requirements. Each cell can be arranged in a staggered or in-line array of cells extending along the main body wall of the blade. With this cooling construction approach, the usage of cooling air is maximized for a given airflow inlet gas temperature and pressure profile. In addition, the vortex chambers in each of the cells generate high coolant flow turbulence levels and yields a very high internal convection cooling effectiveness in comparison to the single pass radial flow channels used for internal turbine blade cooling for hereto known blades. The present invention allows for the cooling to match the varying source pressures from inside the cooling supply cavities in the airfoil (not shown) and the differing sink pressures outside the airfoil on its outer surface.

What has been described by this invention is an efficacious cooling technique that has the characteristics of allowing the turbine blade designer to tailor the multi-vortex cooling of a turbine blade to a particular engine application by selecting the cell locations and sizes to accommodate the heat loads contemplated by the blade during the engine operating envelope.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. An airfoil for use in a gas turbine engine, the airfoil having a pressure side and a suction side, and a leading edge and a trailing edge, the airfoil also having an internal coolant supply passage to direct a coolant through the airfoil for cooling and a wall defining an outer airfoil surface, the improvement comprising:

A first cylindrical chamber located in the wall of the airfoil;

A second cylindrical chamber located in the wall of the airfoil;

A radially spaced slot fluidly connecting the internal coolant supply passage to the first cylindrical chamber;

A film cooling slot to fluidly connect the second cylindrical chamber to an external surface of the airfoil;

Coolant fluid connecting means to fluidly connect the first cylindrical chamber to the second cylindrical chamber; and, The radially spaced slot and the coolant fluid connecting means being radially offset from each other in order to promote a vortex flow of the coolant within the first and second cylindrical chambers.

2. The airfoil of claim 1, and further comprising:

A plurality of radially spaced slots each fluidly connecting the internal coolant supply passage to the first cylindrical chamber; and, A plurality of film cooling slots each fluidly connecting the second cylindrical chamber to the external surface of the airfoil.

3. The airfoil of claim 2, and further comprising:

The coolant fluid connecting means to fluidly connect the first cylindrical chamber to the second cylindrical chamber comprises a plurality of span-wise passage.

4. The airfoil of claim 3, and further comprising:

The plurality of span-wise passages connects the first and second cylindrical chambers at a tangent point to the two cylinders such that the span-wise passage is located close to the outer airfoil surface.

5. The airfoil of claim 1, and further comprising:

The coolant fluid connecting means to fluidly connect the first cylindrical chamber to the second cylindrical chamber comprises a span-wise passage.

6. The airfoil of claim 5, and further comprising:

The first and second cylindrical chambers and the span-wise passage being formed in the wall of the airfoil such that a near wall cooling effect of the airfoil is achieved.

7. The airfoil of claim 5, and further comprising:

The span-wise passage connects the first and second cylindrical chambers at a tangent point to the two cylinders such that the span-wise passage is located close to the outer airfoil surface.

8. The airfoil of claim 1, and further comprising:

The coolant fluid connecting means to fluidly connect the first cylindrical chamber to the second cylindrical chamber comprises a third cylindrical chamber, a first span-wise passage means to fluidly connecting the first cylindrical chamber to the third cylindrical chamber, and a second span-wise passage means to fluidly connecting the third cylindrical chamber to the second cylindrical chamber.

9. The airfoil of claim 1, and further comprising:

The coolant fluid connecting means to fluidly connect the first cylindrical chamber to the second cylindrical chamber comprises a plurality of cylindrical chambers and a plurality of span-wise passages, all of the cylindrical chambers being fluidly connected in series by the span-wise passages connecting an upstream cylindrical chamber to a downstream and adjacent cylindrical chamber, and where the span-wise passages are offset in a radial direction in order to promote a vortex flow of the coolant within all of the cylindrical chambers.

10. The airfoil of claim 1, and further comprising:

The film cooling slot is angled with respect to the airfoil surface such that the film cooling effect of the coolant being discharged from the blade is increased.

11. The airfoil of claim 1, and further comprising:

The radially spaced slot is located in an upstream direction of hot gas flow over the airfoil from the film cooling slot.

12. The airfoil of claim 1, and further comprising:

The radially spaced slot is located in a downstream direction of hot gas flow over the airfoil from the film cooling slot.

13. The airfoil of claim 1, and further comprising:

The suction side and the pressure side of the airfoil each having a plurality of cells, each cell having a first cylindrical chamber and a second cylindrical chamber with a radially spaced slot fluidly connecting the internal coolant supply passage to the first cylindrical chamber, each cell having a film cooling slot to fluidly connect the second cylindrical chamber to the external surface of the airfoil, and each cell comprising coolant fluid connecting means to fluidly connect the first cylindrical chamber to the second cylindrical chamber.

14. The airfoil of claim 13, and further comprising:

Each cell comprising a plurality of radially spaced slots, a plurality of film cooling slots, and coolant fluid connecting means comprising a plurality of span-wise passages.

* * * * *